US005100213A

United States Patent [19]

Vandarakis et al.

[11] Patent Number: 5,100,213

[45] Date of Patent: Mar. 31, 1992

[54] VERTICAL SLIDING CHILLER COMPARTMENT DOOR

[75] Inventors: Toni L. Vandarakis, Iowa City; Jeffrey L. Prunty, Swisher; James M. Grace, Elberon, all of Iowa

[73] Assignee: Amana Refrigeration Inc., Lexington, Mass.

[21] Appl. No.: 769,512

[22] Filed: Oct. 1, 1991

Related U.S. Application Data

[63] Continuation of Ser. No. 534,224, Jun. 7, 1990, abandoned.

[51] Int. Cl.[5] ..... F25D 11/00

[52] U.S. Cl. ..... 312/405; 312/292; 312/321.5; 312/344.1; 49/419; 49/421

[58] Field of Search ..... 312/211, 212, 214, 291, 312/292, 293, 321.5, 344.1, 348, 350; 49/409, 419, 421, 438

[56] References Cited

U.S. PATENT DOCUMENTS

| | | | |
|---|---|---|---|
| 1,374,206 | 4/1921 | Jacob | 49/438 |
| 2,142,469 | 1/1939 | Williamson et al. | 312/138.1 |
| 2,822,232 | 2/1958 | Lhota | 312/344.1 |
| 2,898,174 | 8/1959 | Schory et al. | 312/292 |
| 3,851,939 | 12/1974 | Benasutti et al. | 312/350 |
| 3,982,798 | 9/1976 | Fellwock | 312/214 |
| 4,046,438 | 9/1977 | Benasutti et al. | 312/292 |
| 4,586,347 | 5/1986 | McCarty . | |
| 4,825,595 | 5/1989 | Bancroft | 49/419 |

*Primary Examiner*—Kenneth J. Dorner
*Assistant Examiner*—Gerald A. Anderson
*Attorney, Agent, or Firm*—William R. Clark; Richard M. Sharkansky

[57] ABSTRACT

A vertical sliding door for a compartment within the main door of a refrigerator. A frame is positioned adjacent the front of the door liner and has opposing vertical U-shaped channels. The sliding door includes a cover portion having laterally extending vertical runners that are slidably engaged in the respective channels. Each of the runners has a pair of notches into which glide members are snapped. Each of the glide member has a mid portion boss that extends laterally beyond the runner edge to provide a smooth bearing surface for engagement with the U-shaped channel. In the open position, at least one of the glide member bosses is received in a detent to hold the compartment door open.

13 Claims, 5 Drawing Sheets

VERTICAL SLIDING CHILLER COMPARTMENT DOOR

This application is a continuation of application Ser. No. 534,224 filed June 7, 1990, now abandoned

BACKGROUND OF THE INVENTION

The field of the invention generally relates to refrigerators, and more particularly relates to a door for a compartment that is maintained at a temperature slightly lower than the rest of the fresh food chamber.

As is well known, the fresh food storage section or chamber of a refrigerator is typically maintained in the range 35° F.-40° F. It is also well known that many prefer to store certain items such as beverages at a slightly lower temperature such as, for example, in the range 32° F.-35° F. Accordingly, some prior art refrigerators have a so-called chiller compartment within the fresh food chamber, and the chiller compartment is maintained at a slightly lower temperature. A desirable location for such a chiller compartment is within the refrigerator door of a side-by-side refrigerator/freezer because such location provides quick and easy access to the items stored in the chiller compartment.

One such chiller compartment is described in U.S. Pat. No. 4,586,347. In the refrigerator described therein, cold air is channeled from the evaporator through a duct within the partition between the refrigerator and freezer, and is directed through a void in the side of the chiller compartment that is located in the main refrigerator door. The chiller compartment can be accessed through a small hinged door in the main refrigerator door so that items can be loaded into or retrieved from the chiller compartment without opening the main refrigerator door. The chiller compartment can also be accessed from inside when the main refrigerator door is open, and an inner door is provided to isolate the chiller compartment so that the chiller compartment can be maintained at a temperature slightly lower than the rest of the fresh food chamber. Such inner door has a top hinge and the door is swung upwardly from the bottom. A disadvantage of such arrangement is that the door will not stay open on its own so the operator needs two hands to load or retrieve an item such as a milk container. That is, one hand is generally required to hold the inner door open while the milk container is moved with the other hand. Further, if the inner door were provided with a stop that held the inner door open without operator assistance, the inner door could be broken or damaged if the main refrigerator door were closed and the inner door was inadvertently left open.

SUMMARY OF THE INVENTION

It is an object of the invention to provide an improved inner door arrangement for a chiller compartment located within a refrigerator door.

It is also an object to provide a chiller compartment door with a stop so that the chiller compartment door will stay open without being held.

It is a further object to provide a chiller compartment door that will not be damaged if inadvertently left open when the main refrigerator door is closed.

It is a further object to provide a chiller compartment door that is inexpensive to fabricate, is durable, and also is easy and convenient to operate.

It is also an object to provide a chiller compartment arrangement that also serves to cool the main refrigerator door.

In accordance with the invention, these and other objects and advantages are provided by a vertically sliding door adapted for sealing a chiller compartment located in the inside liner of a refrigerator door. The inner door arrangement includes a frame that is connected to the liner and has opposing vertical tracks, each of which includes a U-shaped channel facing the U-shaped channel of the opposite one of the tracks. Each of the U-shaped channels has a detent. The arrangement further includes a door member that has a face plate and a vertical runner extending laterally from each side edge. Each of the runners is positioned in vertically sliding engagement in a respective one of the U-shaped channels of the frame wherein the door member is vertically slidable between a downward closed position and an upward open position. Each of the runners has a glide member with a boss that extends beyond the lateral edge of the respective runner, and each boss is vertically aligned to be received in a respective one of the track detents when the door member is in the open position to provide a stop.

In a preferred arrangement, each of the runners has at least one notch and each of the glide members is snap fit into a respective one of the notches. Preferably, each notch has a top and bottom indent and each of the glide members has a top ear engaged in the top indent and a bottom ear engaged in the bottom indent. The boss of the glide member preferably comprises a mid portion that is wider than the top and bottom ears, and the respective ears each may be connected to the mid portion by a narrow neck. Preferably, the glide member is made from a resilient material so that each glide member can flex laterally inwardly to compensate for spacing tolerances between opposing tracks.

With such arrangement, the inner door slides vertically and, even when it is open, it remains in the general vertical plane of the main refrigerator door a contrasted with a hinged inner door that would swing out. Thus, an open position stop can be and is provided for the inner door because it won't be damaged if it is inadvertently left open when the main refrigerator door is closed. In short, the inner door arrangement facilitates unobstructed main refrigerator door closure regardless of whether the inner door is closed or open.

With such arrangement, the inner door assembly is relatively easy to fabricate because the door member and frame can both be injection molded, and the glide members easily snap into the respective notches of the runners. The shape and resilient characteristics of the glide members enable the mid portions to flex or bend inwardly so as to compensate for variations in the spacing between respective side tracks, while still providing an interference sliding action against the bottoms of the U-shaped channels. The glide members prevent free fall dropping of the door member, and by having glide members at the top and bottom, racking is also prevented. By using a snap-in glide member, the face plate and the glide member can be made of different materials that are selected to optimize their respective functions. Specifically, the face plate can be made of a transparent plastic that can be injection molded, and the glide member can be made of a material such as nylon that provides a smooth bearing surface and also resists wear.

BRIEF DESCRIPTION OF THE DRAWINGS

The foregoing objects and advantages will be more fully understood by reading the description of the preferred embodiments with reference to the drawings wherein.

DESCRIPTION OF THE PREFERRED EMBODIMENTS

Figure 1:
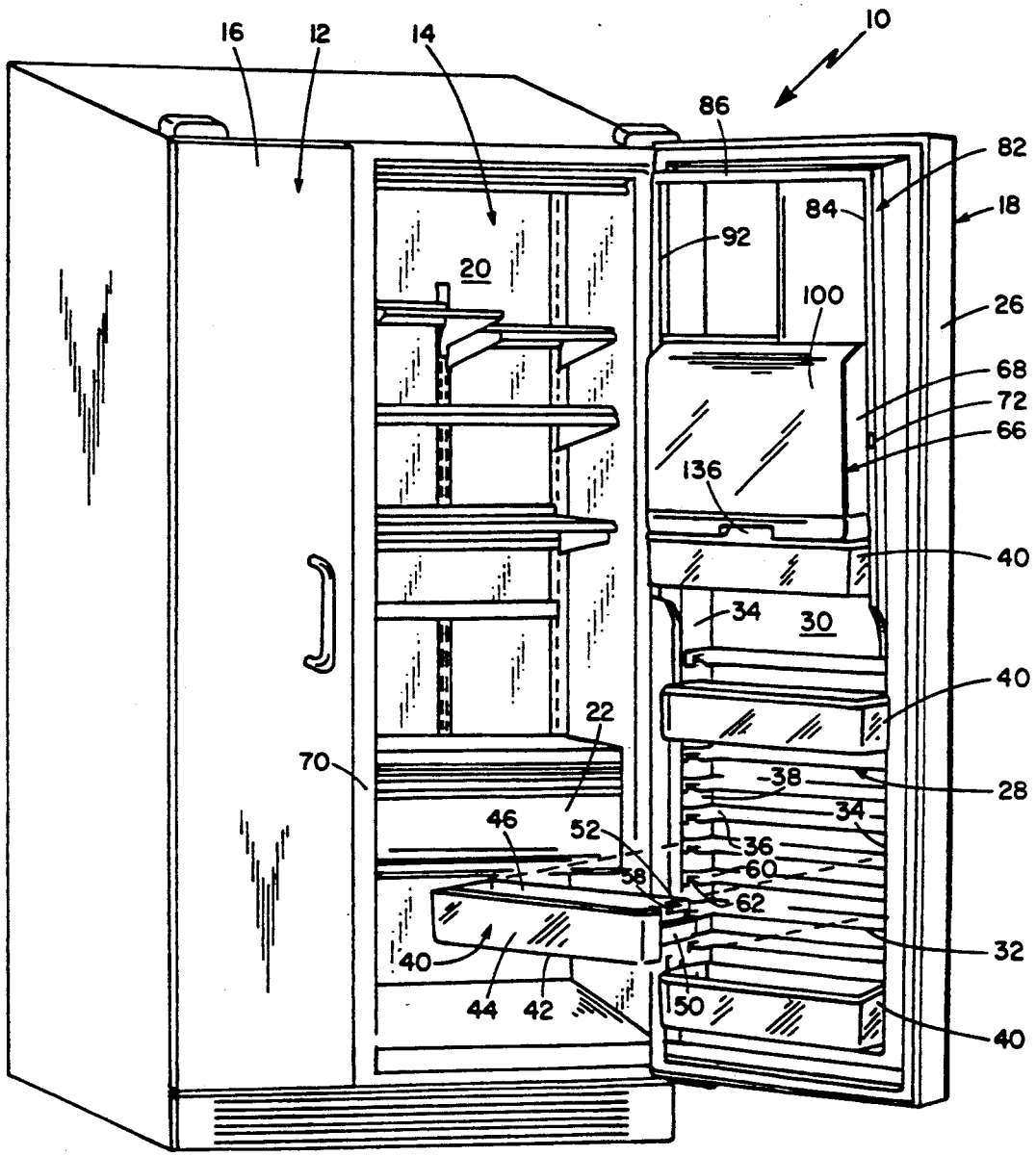
FIG. 1 is a front perspective view of a side-by-side refrigerator with the refrigerator door open.

Referring to FIG. 1, refrigerator 10 is depicted as a so-called side-by-side refrigerator although the invention can be used to advantage with other types of refrigerators. That is, refrigerator 10 includes a freezer section 12 on one side, and a refrigerator section 14 or fresh food section on the other side. The freezer section 12 is provided with freezer door 16, and the refrigerator section 14 is sealed by refrigerator door 18 which is here shown in the open position. In conventional manner, the fresh food chamber 20 or cavity of the refrigerator section 14 is provided with a supply of sub-freezing air from the evaporator (not shown) so as to preferably maintain chamber 20 at an operator selected temperature within the range of 35° F.–40° F. Also in conventional manner, a crisper drawer 22 provides a storage zone with controlled humidity.

Door 18 is the main or outer refrigerator door for the fresh food chamber 20, and generally includes an insulation layer 29 (FIG. 6) sandwiched between an outer shell 26 or casing and an inner liner 28. Liner 28 is preferably a vacuum formed plastic part, and has a central recess 30 bounded by a back wall 32 and parallel opposing side panels 34 or vertical dikes. As shown, side panels 34 have a plurality of substantially horizontal ribs 36 thereby forming channels 38 therebetween. The channels 38 are arranged in corresponding pairs of channels 38 on opposing side panels 34 for mounting bucket shelves 40 in refrigerator door 18.

Figure 2:
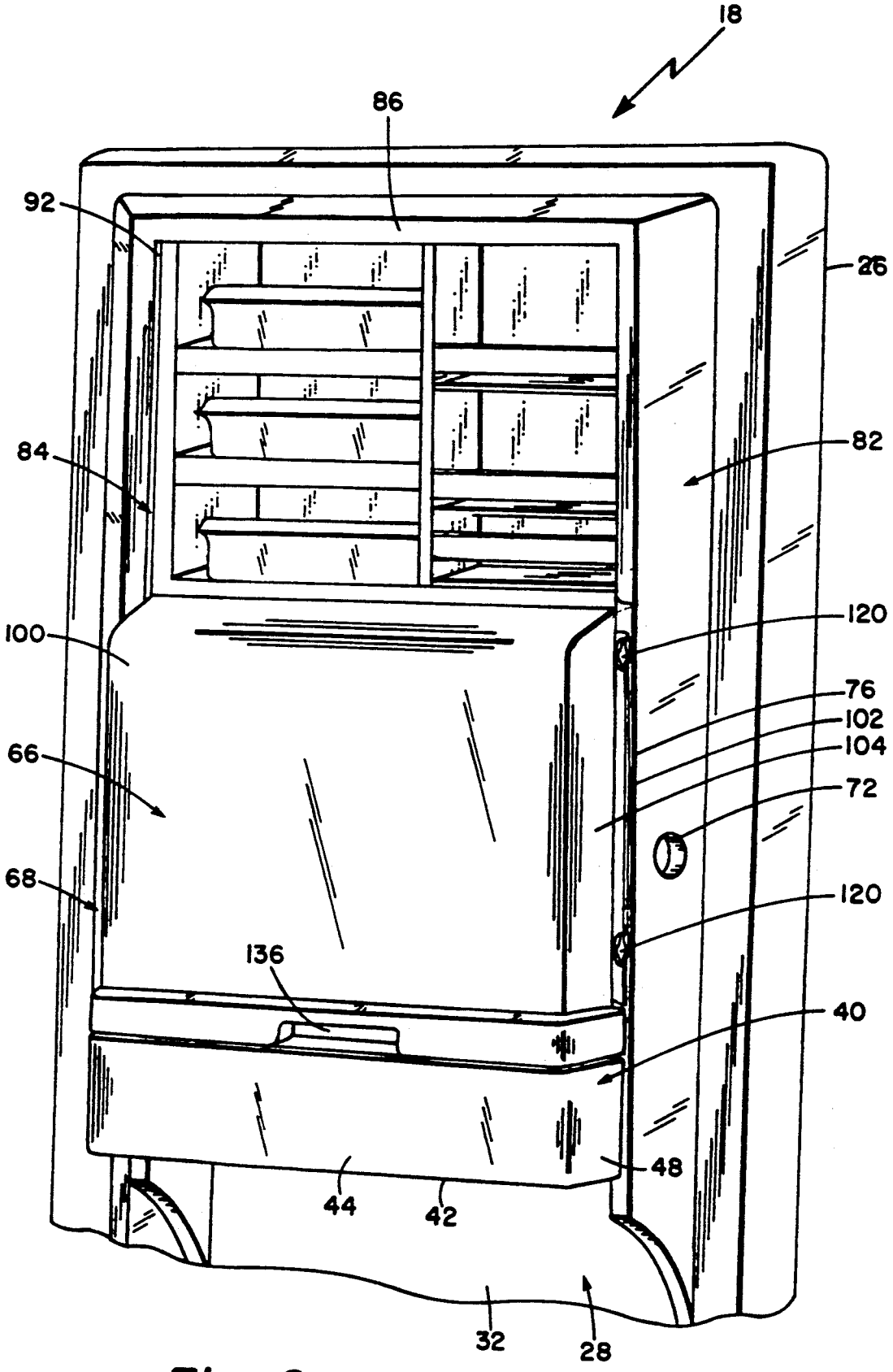
FIG. 2 is an expanded view of the refrigerator door showing the chiller compartment.
Figure 3:
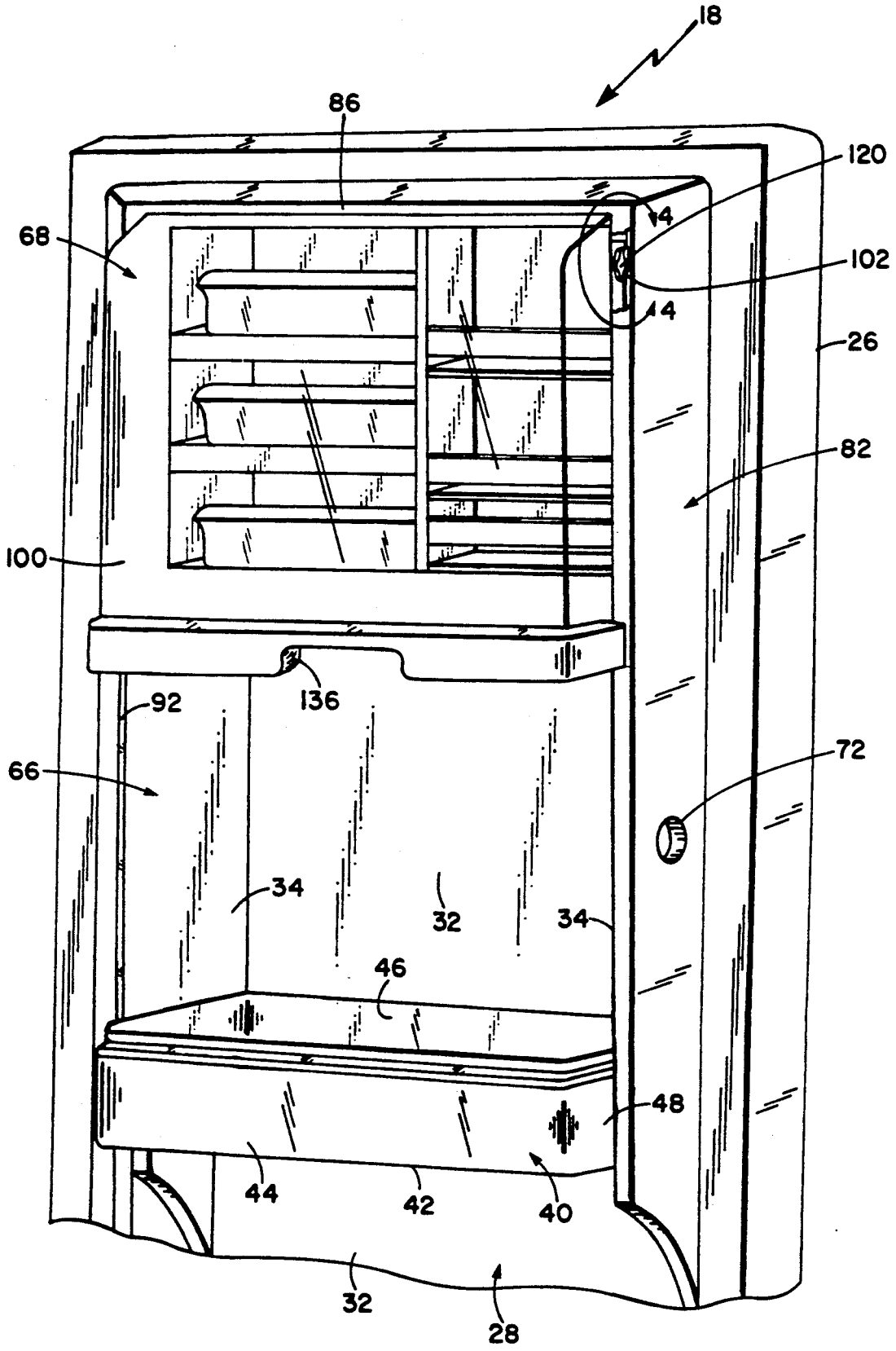
FIG. 3 is a view similar to FIG. 2 with the chiller compartment door open.
Figure 6:
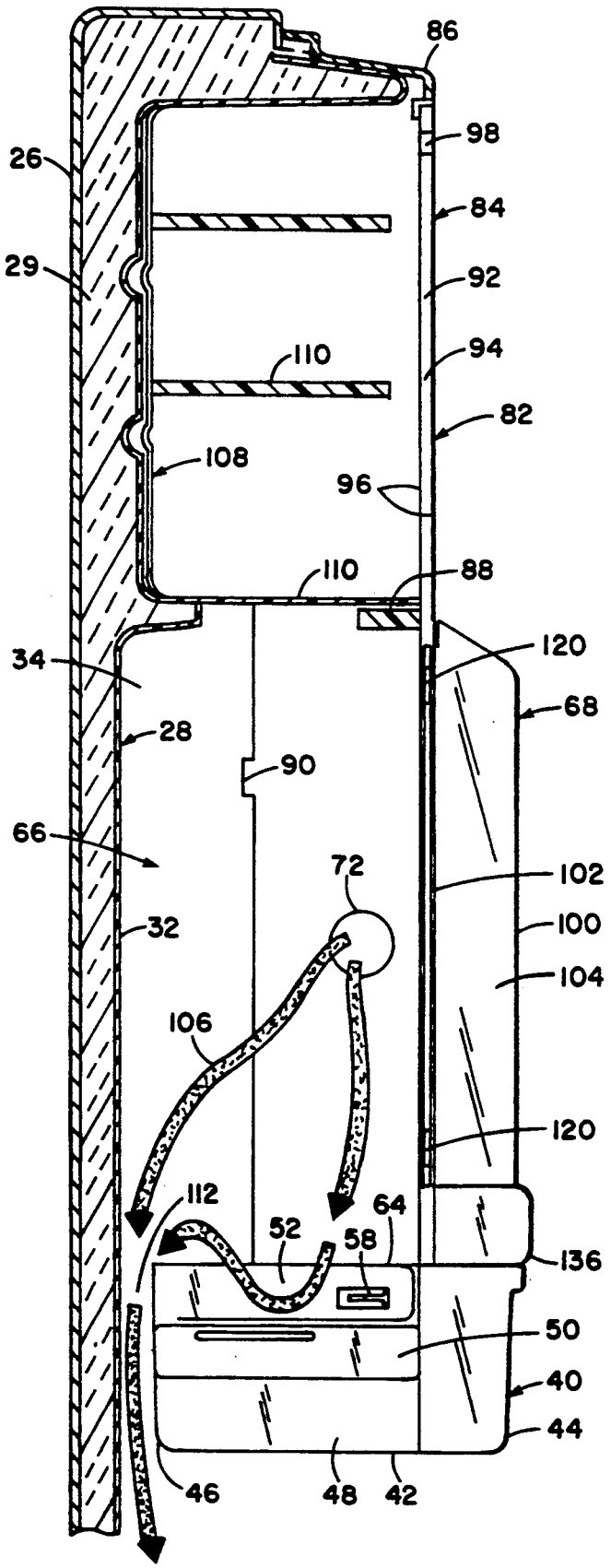
FIG. 6 is a side sectioned view of the chiller compartment.

Also, referring to FIG. 2, 3, and 6, bucket shelves 40 are plastic injection molded parts that include a bottom 42, a front wall 44, a back wall 46, and ends 48. Each end 48 has a generally horizontal rail 50 adapted to be inserted into a respective one of a corresponding pair of channels 38 on opposing side panels 34 wherein the bucket shelf 40 can be pushed to a fully inserted position where it is supported by liner 28. Each end 48 also has a side flap 52 which is laterally flexible, and flap 52 has an outwardly extending ramp tab 58. Each rib 36 has a laterally facing surface 60 with a notch 62. When mounting a bucket shelf 40 to the liner 28, the flap 52 abuts the laterally facing surface 60 of a rib 36 in sliding engagement. When the ramp tab 58 contacts the laterally facing surface 60 of a rib 36, the flap 52 flexes inwardly as the ramp tab 58 slides along the laterally facing surface 60 until the ramp tab 58 aligns with notch 62. Then, flap 52 is permitted to resiliently flex back to its normal front to back orientation as ramp tab 58 enters notch 62. In such manner, bucket shelves 40 are securely latched or engaged to liner 28. A portion 64 of flap 52 extends above the upper rib 36 forming the guide channel 38 for bucket shelf 40, and this portions 64 can be manually pressed inwardly to remove ramp tabs 58 from respective notches 62 so as to remove bucket shelf 40 from its mounted position.

As shown in FIGS. 2, 3, and 6, a bucket shelf 40 attached to liner 28 in the heretofore described manner serves as a floor or bottom for chiller compartment 66. Chiller compartment 66 is also generally bounded on the sides by side panels 34 or vertical dikes, at the back by back wall 32, and to the front by chiller compartment door 68 or cover. In conventional manner, sub-freezing air from the evaporator (not shown) is directed through a duct (not shown) in the partition 70 that separates the freezer section 12 from the refrigerator section 14, and the air is directed from a port (not shown) in the partition through an aperture 72 in side panel 34. This cold air flows directly into chiller compartment 66, and maintains chiller compartment 66 at a temperature slightly below the rest of the fresh food chamber 20. For example, chiller compartment 66 may typically be maintained at approximately 32°–35° F., while the fresh food chamber 20 is maintained in the range from 35°–40° F.

In accordance with the invention, chiller compartment door 68 is vertically slidable in frame 82 between a closed position as shown in FIG. 2 and an open position as shown in FIG. 3. Frame 82, which is an injection molded plastic part, has opposing vertical side tracks 84 and top and middle cross bars or slats 86 and 88 (FIG. 6) that generally fix the lateral spacing between the side tracks 84. Frame 82 is attached to door liner 28 by suitable manner such as clips or screws, and preferably has locator tabs 90 (FIG. 6) to align the frame 82 to the liner 28. Tracks 84 are generally juxtaposed the front edges of the side panels 34 of liner 28, and the top cross slat 86 surrounds the top of liner 28.

Figure 4:
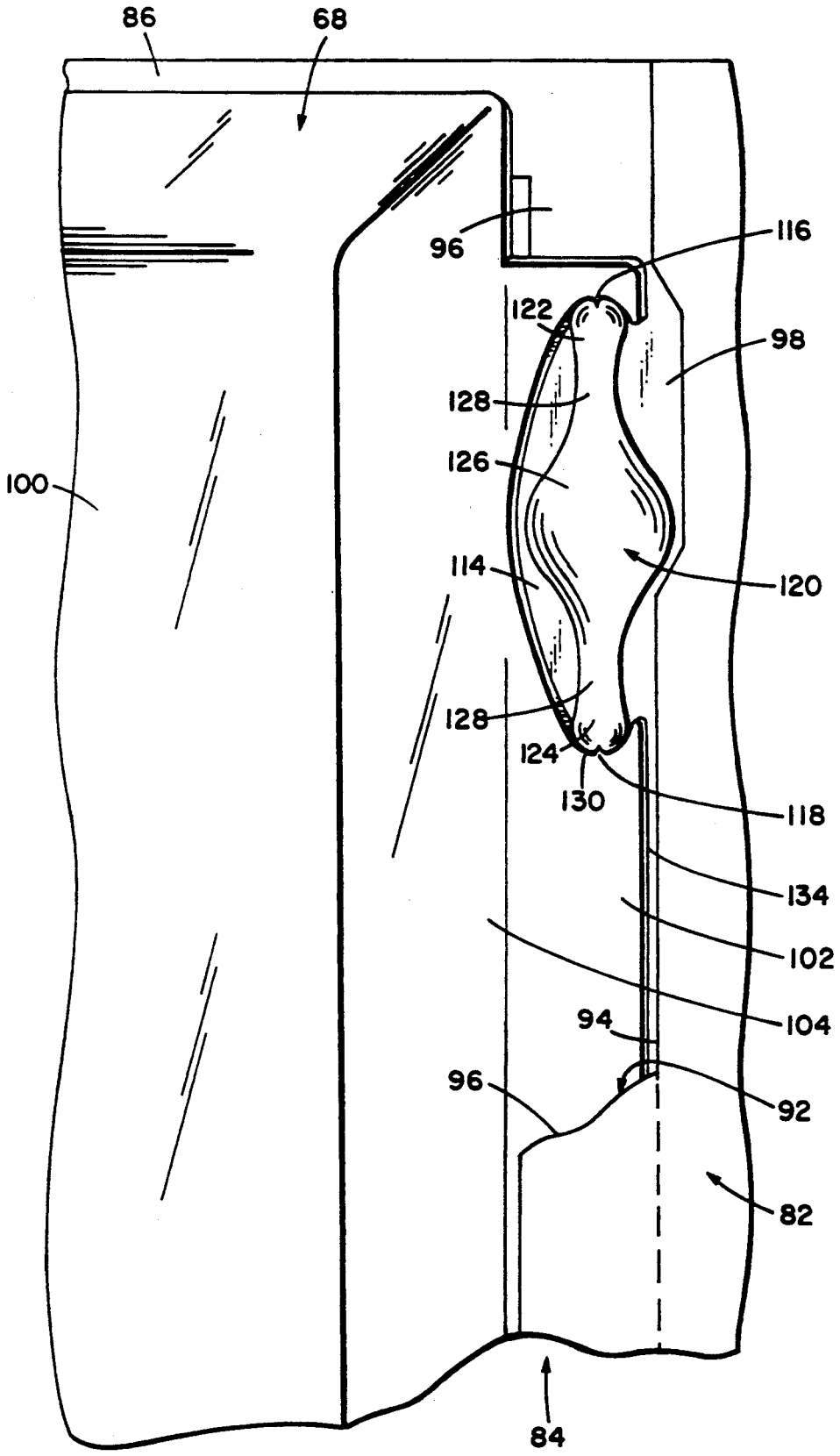
FIG. 4 is an expanded view of the region 4—4 of FIG. 3.

Referring also to FIG. 4, each side track 84 includes a U-shaped channel 92 having a bottom 94 and two sides 96. The U-shaped channel 92 on the left faces the U-shaped channel 92 on the right. As shown in FIG. 4, bottom 94 of U-shaped channel 92 has a detent 98 near the top of track 84.

Chiller compartment door 68 includes a cover portion or face plate 100 having laterally extending vertical runners 102 at each side 104. U-shaped channels 92 are spaced apart and dimensioned so as to receive respective vertical runners 102 in sliding engagement. Thus, chiller compartment door 68 is vertically slidable between a closed position as shown in FIG. 2 and an open position as shown in FIG. 3. Face plate 100 here bows outwardly and generally conforms to the shape of bucket shelf 40 as shown in FIG. 2 so that bucket shelf 40 supports chiller door compartment 68 in the closed position. That is, bucket shelf 40, in addition to providing a floor for chiller compartment 66, also functions as a stop to prevent downward sliding of chiller compartment door 66 past the closed position as shown in FIG. 2. In the closed position, chiller compartment 66 is isolated from the rest of the fresh food chamber 20, and therefore can be maintained at a temperature slightly below the rest of the fresh food chamber 20 by the cold air 106 introduced through aperture 72. As can be seen in FIG. 6, bucket insert 108 having shelves 110 is positioned above chiller compartment 66, and the lower shelf 110 provides the upper boundary of chiller compartment 66. The bucket shelf 40 forming the floor or bottom of chiller compartment 66 as shown in FIG. 6 is spaced from the back wall 32 of liner 28 thereby forming a gap 112. Cold air introduced or directed into chiller compartment 66 through aperture 72 therefore flows through gap 112 and down the door liner 28 to provide additional cooling of the main refrigerator door 18 than would otherwise be provided by the air flow currents within fresh food chamber 20.

Figure 5:
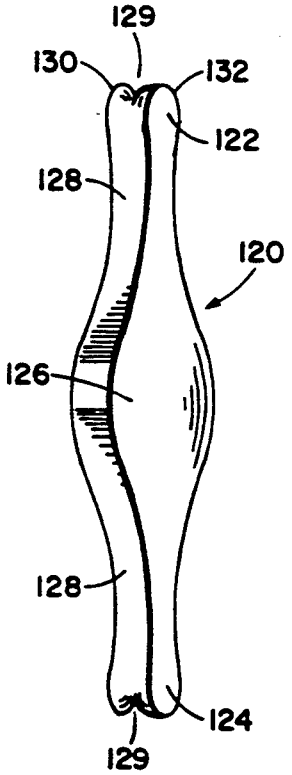
FIG. 5 is a perspective view of a glide member.

Referring to FIG. 2 and also to FIG. 4, vertical runners 102 each have a notch 114 or recess near the top and near the bottom. Each notch has a top indent 116 and a bottom indent 118. As shown in FIG. 4, a glide member 120 is mounted in each notch 114. More specifically, with reference to FIG. 5, each glide member 120 is a nylon part having an upper ear 122, lower ear 124, and a mid portion 126 of expanded width connected to the respective ears 122 and 124 by necks 128 having a reduced cross section. Each ear 122 and 124 has a hollow 129 or concaved extremity, and preferably is slightly wider than the thickness of runners 102 such that a glide member 120 can readily be snapped into a respective notch 114 and held in place in a snap fit with the edges 130 and 132 of the glide member 120 extending slightly beyond the thickness of the runner 102. Typically, glide member 120 may have a height of approximately 1 ½ inches, and a thickness of ⅛ inch. As shown in FIG. 4, the mid portion 126 of glide member 120 extends laterally beyond the lateral edge 134 of runner 102. Thus, when chiller compartment door 68 is in tracks 84 of frame 82, the only part of chiller compartment door 68 that touches the bottom 94 of U-shaped channels 92 is the mid portion 126. Accordingly, the bearing surface area between the chiller compartment door 68 and tracks 82 is very small and precisely fixed.

Glide members 120 have a symmetrical shape such that they can be inserted with up-or-down, front-or-back orientation; there is no need to orient them in one specific alignment. Accordingly, glide members 120 can readily and easily be snapped into notches 114. Because glide member 120 and face plate 100 are snapped together, they are here made of different materials each of which is optimized for the function of the respective part. That is, a relatively inexpensive injection molded process can be used for face plate 100, and a transparent plastic can be used so that the contents of chiller compartment 66 can be viewed with chiller compartment door 68 in the closed position as shown in FIG. 2. The material properties of glide member 120 are such that it provides a smooth bearing surface with a suitable coefficient of friction against bottom 94 of a track 84. Further, glide member 120 is substantially wear resistant. Also, glide member 120 has resiliency so that it can be flexed to snap fit in notch 114, and also so it can bend to provide chiller compartment door 68 with a suitable interference fit between opposing tracks 84.

Still referring to FIG. 4, a detent 98 is provided in the bottom 94 near the upper end of U-shaped channel 92. The chiller compartment door 68 is provided with a handle 136 so that the operator can manually slide the chiller compartment door 68 to the open position as shown in FIG. 3, and when the chiller compartment door 68 reaches such open position, the mid portion 126 of glide member 120 enters detent 98 thereby providing a stop or latch in the open position. That is, when chiller compartment door 68 is slid vertically upward to the open position, a glide member 120 at each side engages a respective detent 98 in the bottom 94 of the U-shaped channel 92 thereby retaining chiller compartment door 68 in the open position. Accordingly, stored items can be placed into or retrieved from the chiller compartment 66 using only one hand; a second hand is not required to hold the chiller compartment door open because it stays open on its own. Further, even in the open position as shown in FIG. 3, chiller compartment door 68 is in the same general plane as refrigerator door 18. Therefore, if the main refrigerator door 18 is closed with the chiller compartment door 68 inadvertently left in the open position, no damage is done to the chiller compartment door 68. The operator pulls downwardly on handle 136 to close chiller compartment door 68, and there is flex in face plate 100, glide members 120 and/or frame 82 so that glide members 120 can slide out of respective detents 98 and down tracks 84. Detents may also provided in a lower region of U-shaped channels 92 so that if bucket shelf 40 is removed for cleaning or other reasons, the chiller compartment door 68 will not slide downwardly out of tracks 84.

This concludes the description of the preferred embodiment. A reading of it by one skilled in the art will bring to mind many modifications and alterations without departing from the spirit and scope of the invention. Accordingly, it is intended that the scope of the invention be limited only by the appended claims.

What is claimed is:

1. A vertically sliding door adapted for sealing a compartment formed in the liner of a refrigerator door, the sliding door comprising:

a frame connected to said liner, said frame having opposing vertical tracks each comprising a U-shaped channel having a bottom and two sides wherein the U-shaped channels face each other and each of the bottoms of said U-shaped channels has a detent;

a door member having a face plate with a vertical runner extending laterally to each side, each of said runners being positioned in vertically sliding engagement in a respective one of said U-shaped channels wherein said door member is vertically slidable between a downward closed position and an upward open position; and each of said runners having at least two notches with a glide member snap fit into each notch, each of said glide members having a boss extending laterally beyond the outer edge of said respective runner so that only said bosses touch the respective bottoms of said U-shaped channels, each of said runners having one of said bosses vertically aligned to be received in a respective one of said detents in said respective U-shaped channels to provide a stop for said door member in said open position.

2. A vertically sliding door adapted for sealing a compartment formed in the liner of a refrigerator door, the sliding door comprising:

a frame connected to said liner, said frame having opposing vertical tracks each comprising a U-shaped channel wherein the U-shaped channels face each other and each of said U-shaped channels has a detent;

a door member having a face plate with a vertical runner extending laterally to each side, each of said runners being positioned in vertically sliding engagement in a respective one of said U-shaped channels wherein said door member is vertically slidable between a downward closed position and an upward open position;

each of said runners having a glide member with a boss extending laterally beyond the outer edge of said respective runner, said boss being vertically aligned to be received in a respective one of said detents in said respective U-shaped channels to provide a stop for said door member in said open position;

wherein each of said runners has at least one notch and each of said glide members is snap fit into a respective one of said notches; and wherein each of said notches has a top and bottom indent, and each of said glide members has a top ear engaged in said top indent and a bottom ear engaged in said bottom indent of a respective one of said notches.

3. The sliding door recited in claim 2 wherein said boss of each of said glide members comprises a mid portion wider than said top and bottom ears.

4. The sliding door recited in claim 3 wherein said mid portion is rounded to minimize the contact area with said U-shaped channel.

5. The sliding door recited in claim 3 wherein said glide members comprise a resilient material and each has a narrow neck connecting said respective top and bottom ears to said mid portion to provide lateral flex of said mid portion.

6. The sliding door recited in claim 2 wherein said frame has at least one cross member fixing the spacing between said tracks.

7. A food storage compartment within the outer door of the fresh food chamber of a refrigerator, the compartment comprising:

a liner of said outer refrigerator door, said liner comprising opposing side panels and a back wall;

a floor positioned between said side panels of said liner;

a frame having opposing vertical guide channels each positioned adjacent a respective one of said side panels;

an inner door separating said compartment from the remainder of said fresh food chamber, said inner door having vertical side runners each positioned in a respective one of said vertical guide channels wherein said inner door is manually slidable in said guide channels between a closed positioned where said compartment is isolated from said fresh food chamber and an open position where items can be inserted into or removed from said compartment; and stop means for preventing said inner door from sliding vertically by gravity in said open and closed positions wherein said stop means comprises at least one notch in one of said runners, said notch having vertically opposing top and bottom indents, said stop means further comprising a glide member having top and bottom ears each in snap-in engagement with a respective one of said top and bottom indents, said glide member have a laterally widened midportion extending laterally beyond the lateral edge of said one of said runners.

8. The compartment recited in claim 7 wherein said stop means further comprises a detent in the respective guide channel of said one of said runners, said guide channel detent being vertically aligned to receive said midportion of said glide member when said inner door is in said open position to hold said inner door open.

9. The compartment recited in claim 8 wherein each of said runners has at least one of said notches with one of said glide members in snap-in engagement.

10. The compartment recited in claim 9 wherein said glide members are nylon.

11. The compartment recited in claim 9 further comprising means for directing cold air into said compartment.

12. The compartment recited in claim 9 wherein said floor comprises a bucket shelf mounted to said liner, said stop means further comprising a portion of said bucket shelf engaged by said inner door in said closed position.

13. The compartment recited in claim 12 further comprising a gap between said liner and said bucket shelf to provide a flow of said cold air through said gap down said liner.

* * * * *